United States Patent [19]

Ableitner

[11] Patent Number: 4,802,448

[45] Date of Patent: Feb. 7, 1989

[54] CUP TAPPET WITH HYDRAULIC PLAY COMPENSATION DEVICE

[75] Inventor: Erich Ableitner, Remseck, Fed. Rep. of Germany

[73] Assignee: Daimler-Benz Aktiengesellschaft, Fed. Rep. of Germany

[21] Appl. No.: 156,607

[22] Filed: Feb. 17, 1988

[30] Foreign Application Priority Data

Feb. 17, 1987 [DE] Fed. Rep. of Germany ..... 3704929

[51] Int. Cl.[4] ..... F01L 1/24

[52] U.S. Cl. ..... 123/90.55; 123/90.56

[58] Field of Search ..... 123/90.46, 90.55, 90.56, 123/90.57, 90.58, 90.59, 90.63, 41.41, 188 AA; 74/569

[56] References Cited

U.S. PATENT DOCUMENTS

| | | | |
|---|---|---|---|
| 2,484,109 | 10/1949 | Meinecke | 123/90.55 X |
| 2,570,854 | 10/1951 | Pierce | 123/90.59 |
| 3,179,094 | 4/1965 | Ribeton | 123/90.55 X |
| 3,670,707 | 6/1972 | Guido | 123/90.58 X |
| 3,897,761 | 8/1975 | Fleischer et al. | 123/90.55 |
| 4,483,281 | 11/1984 | Black | 123/90.55 |

FOREIGN PATENT DOCUMENTS

| | | |
|---|---|---|
| 3203792 | 11/1982 | Fed. Rep. of Germany . |
| 3437478 | 4/1986 | Fed. Rep. of Germany . |

*Primary Examiner*—Willis R. Wolfe

*Attorney, Agent, or Firm*—Barnes & Thornburg

[57] ABSTRACT

A cup tappet is disclosed which has a hydraulic play compensation device for a breather valve of an internal-combustion engine. The play compensation device includes a play compensating element which is composed of components of the cup and of the valve shank in order to simplify the cup tappet structurally.

9 Claims, 2 Drawing Sheets

CUP TAPPET WITH HYDRAULIC PLAY COMPENSATION DEVICE

BACKGROUND AND SUMMARY OF THE INVENTION

The invention relates to a cup tappet with a hydraulic play compensating means for a breather valve of an internal-combustion engine.

A cup tappet having a play compensating element is known from German published unexamined Patent Application (DOS) No. 3,203,792 which is produced and assembled as a separate component separately from the cup and the breather valve. Disadvantages with this arrangement relate to the large number of parts necessary for a valve train with the play compensating means, and the assembly and production outlay associated therewith.

It is therefore an underlying object of the invention to simplify the known cup tappet.

This object is achieved according to the invention by utilizing parts of the valve shank to form the hydraulic play compensating device cylindrical part.

The cup tappets constructed according to the invention can be produced by a simpler production technique than the prior devices referred to above because, due to the use of a valve shank section as a cylindrical part, the separate production of the cylindrical part, by deep drawing, for example, is eliminated.

Furthermore, the cylindrical part requires less installation space in the valve shank than in the case of separate production, so that the cup tappet with the play compensating element constructed according to the invention can be executed more compact structurally and therefore also lighter.

Lastly, the large number of parts is reduced by the inclusion of the cylindrical part in the valve shank, so that at least the cylindrical part is eliminated as a separate component.

Other objects, advantages and novel features of the present invention will become apparent from the following detailed description of the invention when considered in conjunction with the accompanying drawings.

DETAILED DESCRIPTION OF THE DRAWINGS

Figure 1:
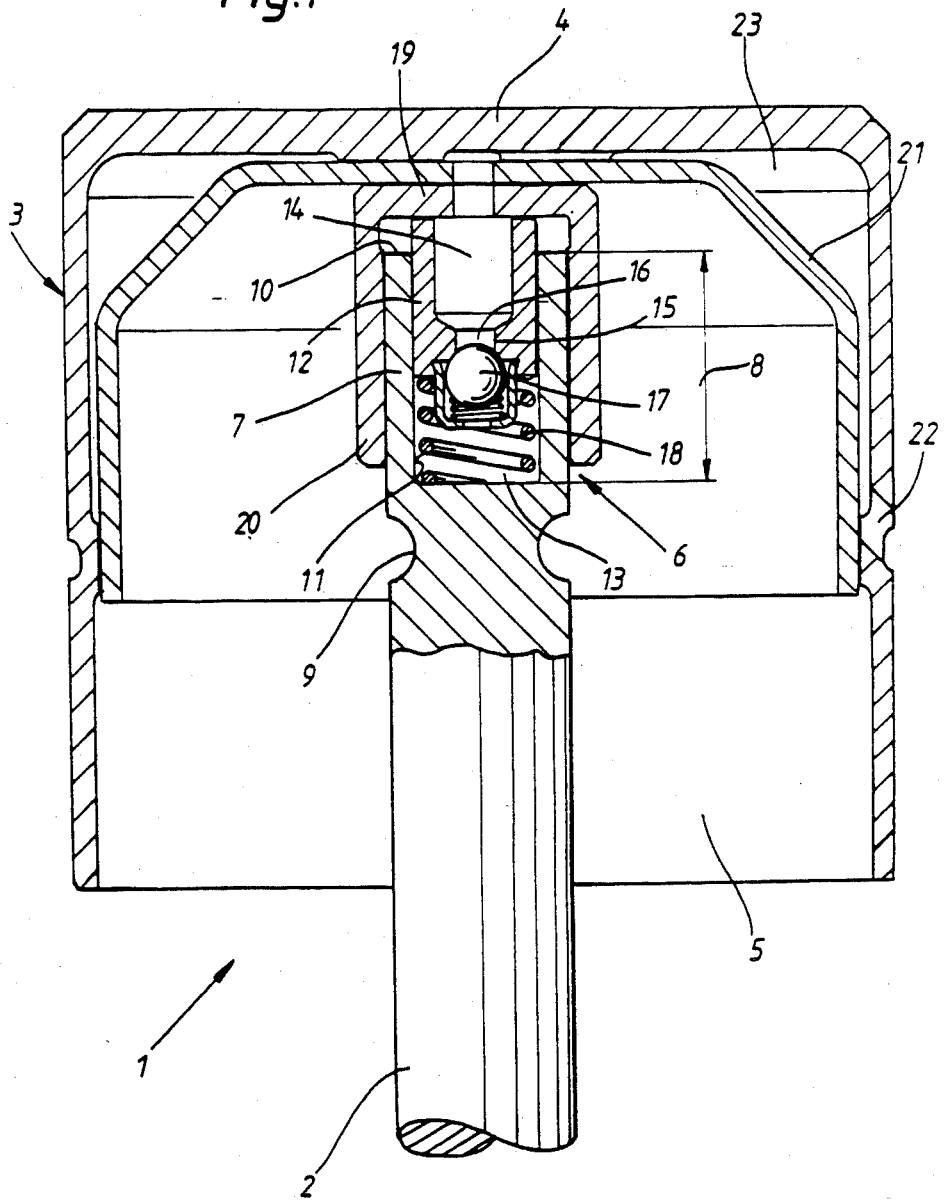
FIG. 1 is a schematic part sectional view which shows a cup tappet having a play compensating element comprising piston and cylindrical part integrated in the valve shank, constructed in accordance with a first preferred embodiment of the invention.

In the exemplary embodiment according to FIG. 1, 1 designates a cup tappet which i arranged in the cylinder head s of an internal-combustion engine, not shown. The cup tappet 1 possesses a cup 3 open towards the valve shank 2 of a breather valve, not further shown. The cup base 4 is influenced by a cam of a cam-shaft. The stroke movement of the cam is transmitted by the cup 3 to the valve shank 2 via a play compensating element 6 arranged in the interior 5.

The play compensating element 6 comprises a hollow cylindrical part 7 which is formed by a shank section 8 of the valve shank 2 and by which the valve shank 2 has been prolonged, starting from the annular groove 9 accommodating the cotter sections of the valve spring plate, as far as the tappet-side shank end 10. A piston part 12, which is guided slidably in the cylindrical part 7 provided with a cylindrical recess 11, encloses a working space 13 with the cylindrical part 7. Space 13 is separated from a storage space 14 located thereabove in the piston part 12 by a piston wall 15. A connecting duct 16, which is present in the piston wall 15, is closed from the direction of the working space 13 by a spring-loaded non-return valve 17. The piston part 12 is moreover urged by a spring 18, inserted in the working space, towards a base section 19 of a guide bushing 20, likewise of cup-shaped construction. The guide bushing 20 is secured by its base section 19, centrally and projecting towards the open side of the cup 3, to a bell-shaped cup holder 21, which is inserted into the interior 5 of the cup 3 and abuts internally the cup base 4 and the cup shell and to which the cup 3 is secured by the cup shell. The valve shank 2 dips by the shank section 8 into the guide bushing 20, whereby both the shank and the play compensating element 6 are guided relative to the cup 3. The oil supply of the play compensating element 6 occurs from the lubricating oil circuit of the engine through a connecting bore 22 in the cup shell and an oil duct 23 leading as far as the storage space 14 in the cup 3.

Figure 2:
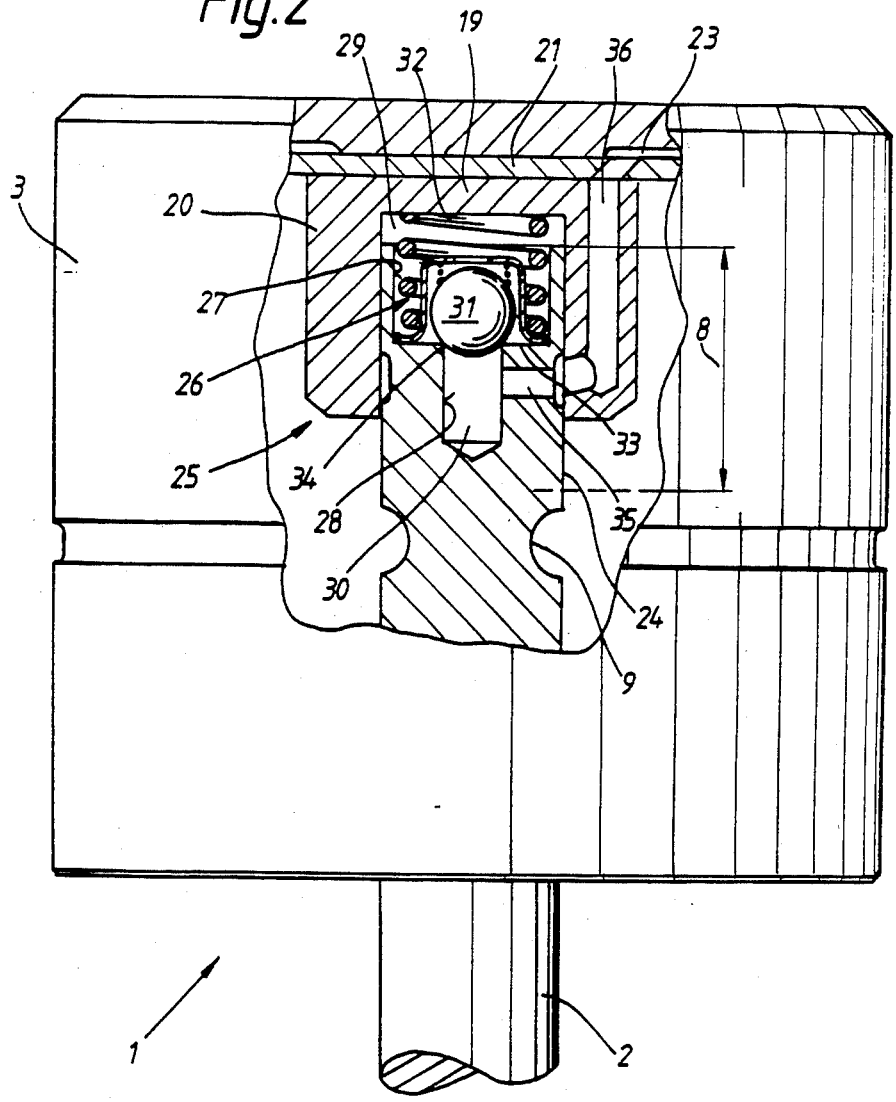
FIG. 2 is a schematic part sectional view which shows a cup tappet having a play compensating element formed by the valve shank and by a guide bushing, constructed in accordance with another preferred embodiment of the invention.

The exemplary embodiment of FIG. 2 differs from that according to FIG. 1 solely in the execution of the play compensating element. The reference numerals from FIG. 1 are therefore used for similar parts in the explanation of FIG. 2.

As in FIG. 1, the prolonged shank section 8 guided in the guide bushing 20 forms the cylindrical part 24 of a play compensating element 25 between the cup 3 and the valve shank 2. Deviating from the construction according to FIG. 1, a graduated recess 26 is provided in the shank section 8, which recess exhibits a cylindrical enlargement 27 starting from the shank end and a tapered longitudinal bore 28 adjoining the latter. The enlargement 27 encloses with the guide bushing 20 the working space 29, which is separated from the storage space 30 located therebeneath and formed by the longitudinal bore 28, by a spring-loaded non-return valve 31. Cup 3 and valve shank 2 are pretensioned in opposite directions by a spring 32 which is braced against a shoulder 33 at the transition between enlargement 27 and longitudinal bore 28 and against the base section 19 of the guide bushing 20. The transition from the shoulder 33 to the longitudinal bore 28 forms a valve seat 34 for the non-return valve 31, which is retained in the closed position by the spring 32. The storage space 30 is connected through a transverse bore 35 in the valve shank 2 and a longitudinal oil bore 36 to the oil duct 23 in the cup 3.

The play compensating element 25 dispenses with a special piston part and is composed only of components belonging to the cup 3 and to the valve shank 2 respectively, for which reason this construction of a play compensation means is characterized by simplicity.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Cup tappet with hydraulic play compensation means for a breather valve of an internal-combustion engine having a cup open towards the breather valve, which cup exhibits a guide bushing arranged hub fashion to receive a hydraulic valve play compensating element having a hollow cylindrical part influencing the valve shank and a piston part guided slidably on the cylindrical part and braced, pretensioned by a spring against the cup base, said piston part and cylindrical part enclosing a working space which is connected through a non-return valve to a storage space which is connected through a duct in the cup to a lubricating oil circuit of the internal-combustion engine, wherein the valve shank is provided along a shank section, starting from the valve shank end, with a cylindrical recess which constitutes the cylindrical part, which is retained in the guide bushing secured internally to the cup base and which conjointly with the guide bushing encloses the storage space and working space.

2. Cup tappet according to claim 1, wherein the shank section is formed by prolongation of the valve shank starting from an annular groove accommodating a valve cotter section of a valve spring plate and extending as far as the shank end.

3. Cup tappet according to claim 1, wherein the piston part is guided slidably in the recess.

4. Cup tappet according to claim 2, wherein the piston part is guided slidably in the recess.

5. Cup tappet according to claim 1, wherein the recess is of graduated construction and comprises an enlargement starting from the shank end and a longitudinal bore adjoining the latter, while the enlargement encloses the working space in which the spring is braced pretensioned against the cup base and against a shoulder at a transition between the enlargement and the longitudinal bore, and wherein the non-return valve is arranged at said transition with its valve element closing the inlet to the longitudinal bore forming the storage space, said longitudinal bore being connected through a transverse bore in the valve shank and a longitudinal oil bore in the guide bushing to an oil duct in the cup.

6. Cup tappet according to claim 2, wherein the recess is of graduated construction and comprises an enlargement starting from the shank end and a longitudinal bore adjoining the latter, while the enlargement encloses the working space in which the spring is braced pretensioned against the cup base and against a shoulder at a transition between the enlargement and the longitudinal bore, and wherein the non-return valve is arranged at said transition with its valve element closing the inlet to the longitudinal bore forming the storage space, said longitudinal bore being connected through a transverse bore in the valve shank and a longitudinal oil bore in the guide bushing to an oil duct in the cup.

7. Cup tappet according to claim 1, wherein the guide bushing is secured centrally and projects towards its open side to the base of a cup holder of bell-shaped construction which is inserted in the interior of the cup abutting the cup base and the cup shell and to which the cup is secured by the cup shell.

8. Cup tappet according to claim 2, wherein the guide bushing is secured centrally and projects towards its open side to the base of a cup holder of bell-shaped construction which is inserted in the interior of the cup abutting the cup base and the cup shell and to which the cup is secured by the cup shell.

9. Cup tappet according to claim 5, wherein the guide bushing is secured centrally and projects towards its open side to the base of a cup holder of bell-shaped construction which is inserted in the interior of the cup abutting the cup base and the cup shell and to which the cup is secured by the cup shell.

* * * * *